US009930462B2

(12) United States Patent
Goshen et al.

(10) Patent No.: US 9,930,462 B2
(45) Date of Patent: Mar. 27, 2018

(54) SYSTEM AND METHOD FOR ON-SITE MICROPHONE CALIBRATION

(71) Applicant: InSoundz Ltd., Raanana (IL)

(72) Inventors: Tomer Goshen, Tel Aviv (IL); Emil Winebrand, Petach Tikva (IL)

(73) Assignee: InSoundz Ltd., Ra'anana (IL)

( * ) Notice: Subject to any disclaimer, the term of this patent is extended or adjusted under 35 U.S.C. 154(b) by 0 days.

(21) Appl. No.: 14/852,571

(22) Filed: Sep. 13, 2015

(65) Prior Publication Data

US 2016/0080880 A1 Mar. 17, 2016

Related U.S. Application Data

(60) Provisional application No. 62/050,137, filed on Sep. 14, 2014.

(51) Int. Cl.
*H04R 29/00* (2006.01)

(52) U.S. Cl.
CPC ..... *H04R 29/005* (2013.01); *H04R 2201/401* (2013.01); *H04R 2499/11* (2013.01)

(58) Field of Classification Search
CPC .. H04R 27/00; H04R 1/406; H04R 2201/401; H04R 2227/005; H04R 25/356; H04R 3/002; H04R 3/005; H04R 2227/003; H04R 2499/11; H04R 2499/13; H04R 29/005; H04R 29/004
USPC ..... 381/71.1, 106, 92, 94.1, 107, 108, 58, 381/71.11, 71.12, 71.14, 122, 56, 66, 381/71.13, 71.2, 71.6, 71.8, 81, 94.2, 381/94.3, 94.5, 94.7
See application file for complete search history.

(56) References Cited

U.S. PATENT DOCUMENTS

| | | | | |
|---|---|---|---|---|
| 4,741,038 | A | 4/1988 | Elko et al. | |
| 5,335,011 | A | 8/1994 | Addeo et al. | |
| 6,449,593 | B1 | 9/2002 | Valve | |
| 6,707,910 | B1 | 3/2004 | Valve et al. | |
| 6,836,243 | B2 | 12/2004 | Kajala | |
| 7,706,549 | B2 | 4/2010 | Zhang et al. | |
| 7,986,794 | B2 | 7/2011 | Zhang | |
| 2005/0018861 | A1* | 1/2005 | Tashev | H04R 1/406 381/92 |
| 2013/0003981 | A1* | 1/2013 | Lane | H04S 7/301 381/58 |
| 2013/0034241 | A1 | 2/2013 | Pandey et al. | |
| 2013/0051577 | A1 | 2/2013 | Morcelli et al. | |
| 2013/0170666 | A1* | 7/2013 | Ng | H04R 29/006 381/92 |
| 2013/0216046 | A1 | 8/2013 | Ikeda et al. | |

(Continued)

*Primary Examiner* — Akelaw Teshale
(74) *Attorney, Agent, or Firm* — M&B IP Analysts, LLC

(57) ABSTRACT

A system and method for on-site calibration of a plurality of microphones in a three-dimensional space are provided. The method includes causing a generation of a plurality of transmissions; causing each microphone to capture each transmission, wherein one of the microphones is selected as a reference microphone; estimating, for each microphone, a plurality of location pointers based on the captured transmissions, wherein each location pointer represents a time difference between the microphone and the reference microphone; determining, based on each location pointer, at least one location parameter for each microphone; and calibrating the plurality of microphones based on the at least one location parameter.

20 Claims, 4 Drawing Sheets

(56) References Cited

U.S. PATENT DOCUMENTS

| | | | | |
|---|---|---|---|---|
| 2014/0029761 | A1 | 1/2014 | Maenpaa et al. | |
| 2014/0180684 | A1* | 6/2014 | Strub | G10L 19/008 704/211 |

* cited by examiner

SYSTEM AND METHOD FOR ON-SITE MICROPHONE CALIBRATION

CROSS-REFERENCE TO RELATED APPLICATIONS

This application claims the benefit of U.S. Provisional Application No. 62/050,137 filed on Sep. 14, 2014, the contents of which are hereby incorporated by reference.

TECHNICAL FIELD

The present disclosure relates generally to calibration of microphone arrays, and more particularly to systems and methods for calibrating microphone arrays on-site.

BACKGROUND

To achieve optimal performance of a microphone array (or any other grouping of microphones), each microphone in the array must be calibrated. Typically, microphone calibration involves measuring the gain of the microphone. During automatic microphone array calibration, gain measures of each microphone in the array are utilized to determine various parameters of the array. Even minor deviations may affect this measurement and, therefore, the parameterization, thereby decreasing the effectiveness of subsequent calibrations. Thus, existing solutions for microphone array calibration require measuring gain in an echoless chamber to be effective.

The need for anechoic (echoless) chambers during parameterization presents various difficulties to microphone array users. In particular, the person who performs the parameterization may not be able to conveniently move echoless chambers to the location of the microphones (or vice-versa). In particular, because chambers used for parameterization must typically be much larger than the setup (microphone array), the microphone array must often be moved to the chambers. However, moving the microphones to the camber is not always possible. For example, nearby echoless chambers are not always available.

Additionally, the requirement to test and calibrate microphones only in echoless chambers may prove challenging when testing the microphones in a real world environment. A user may wish to parameterize a group of microphones once the microphones have been set up in an echoic area if, for example, the user wishes to ensure that the microphone array is still prepared after being moved to the location in which it will be utilized in and/or after repositioning any of the microphones in the array. Requiring users to place the array back in an echoless chamber after such modifications may delay use of the array.

It would therefore be advantageous to provide an efficient solution for calibrating an array of microphones on-site.

SUMMARY

A summary of several example embodiments of the disclosure follows. This summary is provided for the convenience of the reader to provide a basic understanding of such embodiments and does not wholly define the breadth of the disclosure. This summary is not an extensive overview of all contemplated embodiments, and is intended to neither identify key or critical elements of all embodiments nor to delineate the scope of any or all aspects. Its sole purpose is to present some concepts of one or more embodiments in a simplified form as a prelude to the more detailed description that is presented later. For convenience, the term "some embodiments" may be used herein to refer to a single embodiment or multiple embodiments of the disclosure.

The disclosed embodiments include a method for on-site calibration of a plurality of microphones in a three-dimensional space. The method comprises causing a generation of a plurality of transmissions; causing each microphone to capture each transmission, wherein one of the microphones is selected as a reference microphone; estimating, for each microphone, a plurality of location pointers based on the captured transmissions, wherein each location pointer represents a time difference between the microphone and the reference microphone; determining, based on each location pointer, at least one location parameter for each microphone; and calibrating the plurality of microphones based on the at least one location parameter.

The disclosed embodiments also include a system for on-site calibration of a plurality of microphones in a three-dimensional space. The system comprises a processing unit; and a memory, the memory containing instructions that, when executed by the processing unit, configure the system to: cause a generation of a plurality of transmissions; cause each microphone to capture each transmission, wherein one of the microphones is selected as a reference microphone; estimate, for each microphone, a plurality of location pointers based on the captured transmissions, wherein each location pointer represents a time difference between the microphone and the reference microphone; determine, based on each location pointer, at least one location parameter for each microphone; and calibrate the plurality of microphones based on the at least one location parameter.

BRIEF DESCRIPTION OF THE DRAWINGS

The subject matter disclosed herein is particularly pointed out and distinctly claimed in the claims at the conclusion of the specification. The foregoing and other objects, features, and advantages of the disclosed embodiments will be apparent from the following detailed description taken in conjunction with the accompanying drawings.

DETAILED DESCRIPTION

Figure 1:
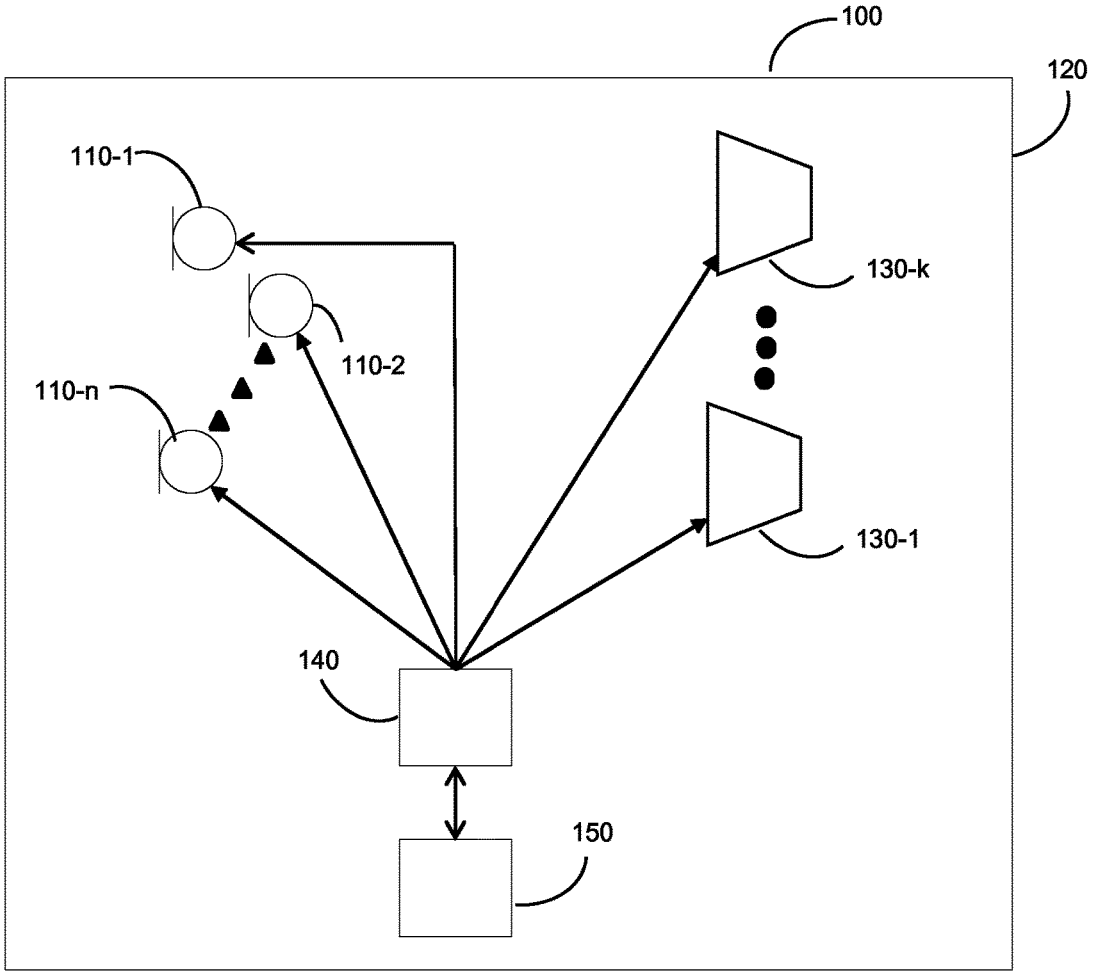
FIG. 1 is a block diagram of a system for on-site parameter generation for microphones according to an embodiment.

It is important to note that the embodiments disclosed herein are only examples of the many advantageous uses of the innovative teachings herein. In general, statements made in the specification of the present application do not necessarily limit any of the various claimed embodiments. Moreover, some statements may apply to some inventive features but not to others. In general, unless otherwise indicated, singular elements may be in plural and vice versa with no loss of generality. In the drawings, like numerals refer to like parts through several views.

By way of example for the various disclosed embodiments, a method and system for calibrating microphones on-site are provided. According to one exemplary embodiment, a plurality of transmissions are generated and captured by each microphone of a plurality or array of microphones. Based on each of the generated transmissions, two location pointers are determined for each microphone. Based on the two determined location pointers, at least one location parameter for each microphone may be determined. The location parameters illustrate the position of each microphone with respect to other microphones and/or the sound sources.

FIG. 1 shows an exemplary and non-limiting diagram of a system 100 for on-site calibration of a plurality of microphones according to an embodiment. The system 100 includes a plurality of microphones 110-1 through **110-*n* (hereinafter referred to collectively as microphones 110 or individually as a microphone 110, merely for simplicity purposes), where n is an integer greater than or equal to 1, a plurality of sound sources 130-1 through 130-*k* (hereinafter referred to collectively as sound sources 130 and individually as a sound source 130, merely for simplicity purposes), and a control unit (CU) 140**. It should be noted that a plurality of sound sources is illustrated merely for simplicity purposes and without any limitation on the disclosed embodiments. One sound source may be moved to a plurality of locations and may generate a transmission at each location without departing from the scope of the disclosed embodiments.

The microphones 110 are placed in a three-dimensional space 120. The location of each microphone 110 within the three-dimensional space 120 is unknown. One of the microphones 110-1 is selected to be a reference microphone and the location coordinates of the reference microphone 110-1 are set as (0, 0, 0).

The sound sources 130 are located within the three-dimensional space 120 and are configured to generate transmissions to be captured by the microphones 110. In an embodiment, the exact location of each sound source 130 in the three-dimensional space 120 is unknown. In a further embodiment, the location of each sound source may be determined. It should be noted that a three-dimensional space is illustrated merely for the sake of simplicity and without any limitations on the disclosed embodiments. The microphones 110 and the sound sources 130 may be organized in a two-dimensional space (e.g., each being at the same z coordinate) without departing from the scope of the disclosed embodiments.

The system 100 further includes a control unit (CU) 140. The control unit 140, in one configuration, is communicatively connected to both the sound sources 130 and to the microphones 110. The connection may be a wired connection, a wireless connection, or a combination thereof. The control unit 140 is configured to cause each of the sound sources 130 to generate transmissions. In an embodiment, the generation of the transmissions is based on metadata. The metadata may include, but is not limited to, a type of transmission to generate, its volume, length, and so on. In another embodiment, the control unit 140 is configured to cause the sound sources 130 to generate transmissions based on user inputs. The control unit 140 is further configure to control the microphone in the array 110 to capture sound sources generated by the sound source 130.

The system 100 may further include a database 150 (or any other type of storage device) that can be accessed by at least the control unit 140. The database 150 can store data related to the operation of both the sound sources 130 and the microphones 110. In an embodiment, the database 150 may store metadata used by the control unit 140 to configure the sound sources 130 to generate transmissions. It should be noted that the metadata of the sound sources 130 is not required for the calculation of the time difference or the exact starting point of transmission.

According to an embodiment, the control unit 140 causes the sound sources 130 to generate a plurality of transmissions. The control unit 140 further causes each of the microphones 110 to capture each transmission. Based on the captured transmissions, the control unit 140 is configured to determine, for each of the microphones 110-2 through **110-*n*, a plurality of location pointers respective of the reference microphone 110-1 in the three-dimensional space 120. Each location pointer represents a time difference between a sound of a transmission captured by the reference microphone 110-1 and a sound of the transmission captured by another microphone 110**.

Each location pointer is determined respective of a transmission captured by the microphone 110-2 through **110-*n*. The analysis may include, but is not limited to, matching between at least a portion of the transmission as it is captured by the microphone 110-1 and by each of the microphones 110-2 through 110-*n* to determine a plurality of time differences for each transmission. The time differences between the respective times at which each of the microphones 110-2 through 110-*n* captures each transmission are indicative of the distances among the microphones 110 within the three dimensional space 120, and may be utilized to determine various location parameters of the microphones 110**.

Specifically, each time difference location pointer is a function of various location parameters of the plurality of microphones and may be utilized in simultaneous equation solving to determine the various location parameters. Further, the determination may differ depending on whether a maximal number of parameters or a compact set of parameters. For example, for a maximal parameterization the relationship between each time difference and various location parameters may be:

$$d_i[j]=f(X_j,Y_j,Z_j,C,X_{si},Y_{si},Z_{si}) \quad \text{Equation 1}$$

wherein $d_i[j]$ is a time difference at a particular microphone **110-*j* (where j is an integer greater than or equal to 1) based on a transmission i, $X_j$ is the X coordinate of the microphone 110-*j*, $Y_j$ is the Y coordinate of the microphone 110-*j*, $Z_j$ is the Z coordinate of the microphone 110-*j*, c is the estimated speed of sound, $X_{si}$ is the X coordinate of the sound source 130-*s* (where s is an integer greater than or equal to 1), $Y_{si}$ is the Y coordinate of the sound source 130-*s*, and $Z_{si}$ is the Z coordinate of the sound source 130-*s***. The minimum number of transmissions required to determine the location parameters for a maximal parameterization is 3.

For a compact (two-dimensional) parameterization requiring fewer parameters to be determined, the relationship between each time difference and various location parameters may be:

$$d_i[j]=f(X_j,Y_j,X_{si},Y_{si}) \quad \text{Equation 2}$$

wherein $d_i[j]$ is a time difference at a particular microphone **110-*j* (where j is an integer greater than or equal to 1) based on a transmission i, $X_j$ is the X coordinate of the microphone 110-*j*, $Y_j$ is the Y coordinate of the microphone 110-*j*, $X_{si}$ is the X coordinate of the sound source 130-*s* (where s is an integer greater than or equal to 1), and $Y_{si}$ is the Y coordinate of the sound source 130-*s***. For compact parameterization, it is assumed that the speed of the sound is a known value. In an embodiment, the minimum number of transmissions required to determine the location parameters for a compact parameterization is 2.

In one embodiment, the control unit 140 is configured to determine at least one location parameter for each of the microphones 110 based on the plurality of location pointers of each of the microphones 110. The location parameters may include, but are not limited to, the location of each microphone in array 110 within the three-dimensional space 120, the distance between each of the microphones 110, and so on.

For each sound source 130, the number of equations required per transmission in order to determine the at least one location parameter is equal to n−1, where n is the total number of microphones 110 in the array. Simultaneous equation solving may be utilized to determine each of the location parameters given the plurality of location pointers in the plurality of equations. As a non-limiting example, for a maximal parameterization (minimum number of transmissions is 3) respective of 4 microphones, the number of equations required per transmission to determine the location parameters is 3. Thus, if 3 transmissions are utilized, 9 equations are utilized in determining location parameters. Simultaneous problem solving techniques are utilized to determine values for the location parameters respective of 9 location pointers and the 9 equations.

In an embodiment, any of the following may also be determined respective of the location pointers: a gain of each microphone 110, a sound velocity within the three-dimensional space 120, metadata related to the phase of each of the microphones 110, and a dispersion of each of the microphones 110.

It should be noted that, by repeating the capturing of the transmissions and the respective analysis and determination, additional location parameters may be determined. It should be further noted that the transmissions may be generated simultaneously without departing from the scope of the disclosed embodiments. Furthermore, the transmissions may be captured simultaneously without departing from the scope of the disclosed embodiments. According to another embodiment, the location of each sound source 130 can also be determined respective of the location pointers.

Following the determination of the at least one location parameter for each of the microphones 110, the control unit 140 calibrates the microphones 110. According to another embodiment, the calibration enables the control unit 140 to mute, eliminate, or reduce the side lobe sounds in order to isolate audio of a desired sound beam within the three-dimensional space 120. The control unit 140 may be further configured to be tuned so as to allow a user to determine a specific area of the sound beam using a beam forming technique.

The system 100 may further be implemented in order to identify a location of an element including the microphones 110. As an example, in a case where the microphones 110 are included in a mobile device, the system 100 may be utilized in order to determine the location of the mobile device in the three-dimensional space 120. The mobile device may be, but is not limited to, a smart phone, a mobile phone, a laptop, a tablet computer, a wearable computing device, a personal computer (PC), and the like. It should be noted that the system 100 enables an accurate determination of the location of the mobile device(s) in cases where the position of the sound source 130 is unknown and determined by the system 100. Therefore, the system 100 may be implemented in a variety of positioning systems such as global positioning systems (GPSs), indoor navigation systems, gaming and gestures on wearable devices, outdoor navigation systems, and so on.

Figure 2:
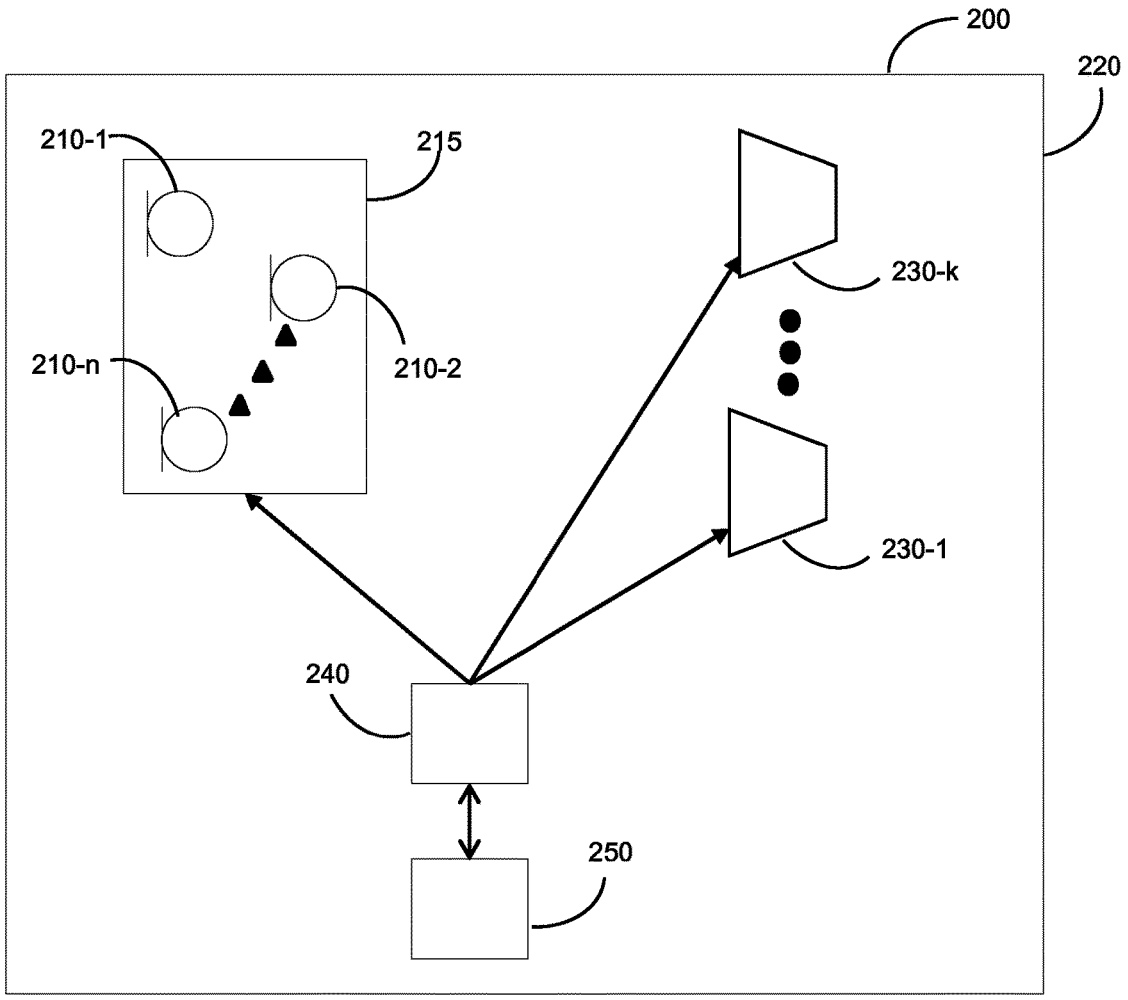
FIG. 2 is a schematic diagram of a system for on-site parameter generation for an array of microphones according to an embodiment.

FIG. 2 depicts an exemplary and non-limiting schematic diagram of a system 200 used for on-site calibration of a microphone array according to an embodiment. In an embodiment, the operation of the system 200 is used in order to determine location parameters respective of the microphones 210-1 through **210-*n* (hereinafter referred to collectively as microphones 210 and individually as a microphone 210, merely for simplicity purposes) located in a microphone array 215**.

In an embodiment, a microphone array may not be included in the system 200. In such an embodiment, the system 200 is configured to communicatively connect to the microphone array such that the system 200 may calibrate the microphones of the array in accordance with the disclosed embodiments. It should be noted that the microphone array 215 may be shaped as, but not limited to, an octagon, a variety of polygons, a plurality of hexagons, and so on. The location of the microphones 210 as well as of the microphone array 210 within the three-dimensional space 220 is unknown.

A control unit 240 is communicatively connected to the array of microphones 215 and to a plurality of sources 230-1 through **230-*k* (hereinafter referred to collectively as sources 230 and individually as a source 230, merely for simplicity purposes). In an embodiment, the control unit 240 causes each source 230 to generate at least one transmission. The control unit 240 configures each of the microphones 210 to capture each generated transmission. The control unit 240 then determines, for each of the microphones 210, a plurality of location pointers for each microphone 210 based on an analysis of the captured transmissions. The microphone array 215** is rotated between transmissions.

The control unit 240 is further configured to compute at least one location parameter of each of the microphones 210 based on the plurality of location pointers for each microphone 210. The location parameters may include, but are not limited to, the exact location of each microphone 210 within the three-dimensional space 220, the distance between each of the microphones 210, an estimated speed of sound in the three-dimensional space, a radius of the microphone array 215, and an angle of rotation.

In addition to the maximal and compact relationships described herein above with respect to FIG. 1, the relationship between each time difference location pointer and various location parameters for the microphones 210 of the microphone array 215 may be based on rotation of a symmetrical array. For rotation of a symmetrical array, the relationship may be:

$$d_i[j]=f(X_j,Y_j,Z_j,C,R,\theta) \qquad \text{Equation 3}$$

wherein $d_i[j]$ is a time difference at a particular microphone **210-*j* (where j is an integer greater than or equal to 1) based on a transmission i, $X_j$ is the X coordinate of the microphone 110-*j*, $Y_j$ is the Y coordinate of the microphone 210-*j*, $Z_j$ is the Z coordinate of the microphone 210-*j***, c is the estimated speed of sound, R is the radius of the array, and theta θ is the angle of rotation. The minimum number of transmissions needed to determine the parameters for an array rotation is 4. Simultaneous equation solving may be utilized to determine each of the location parameters given the plurality of location pointers in the plurality of equations. In this embodiment, the array of microphones is rotated and the sound source location is not changed and could be based on a single sound source where for each measurement interval k, the array rotated in angle $\theta_k$.

Figure 3:
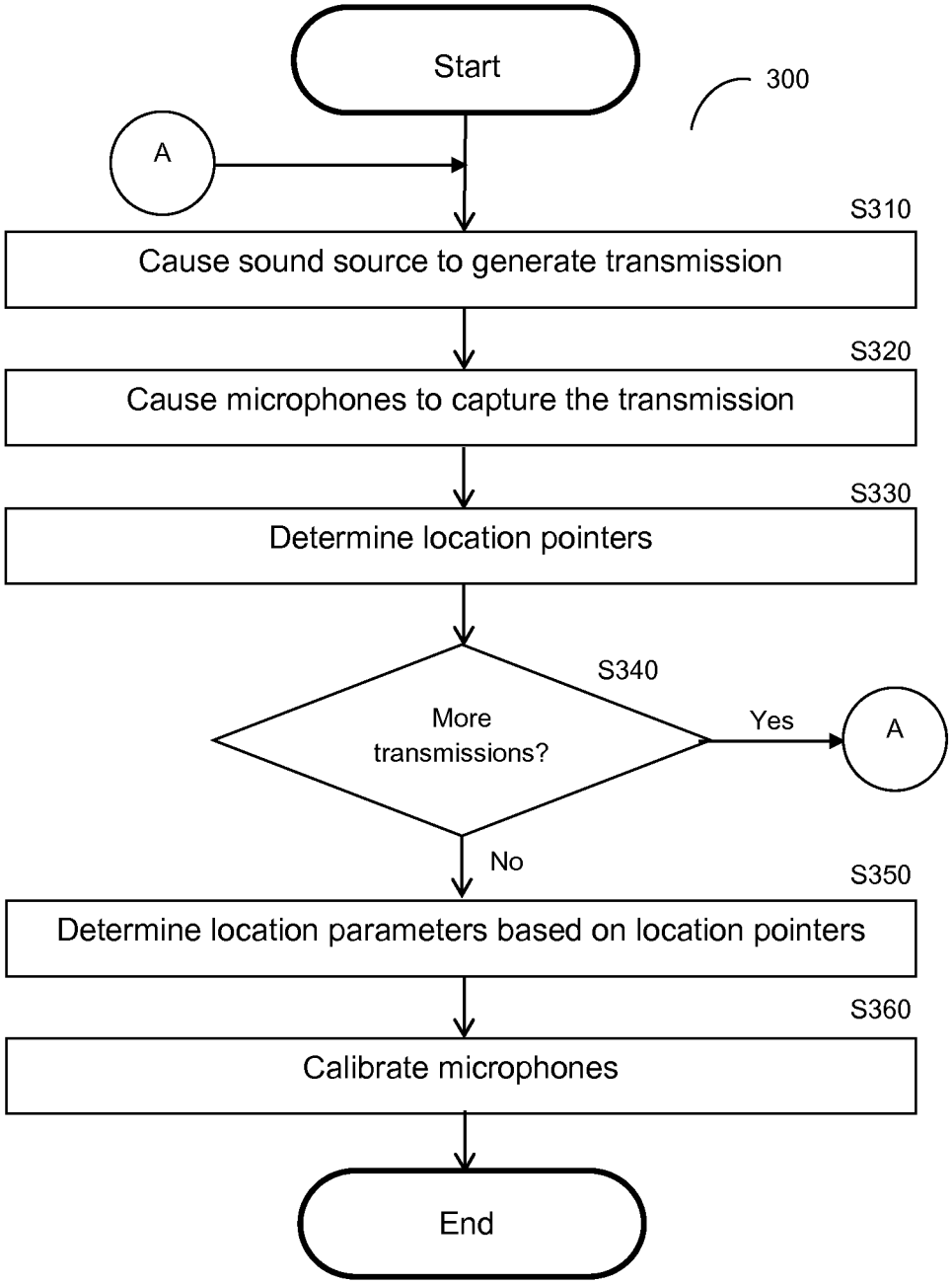
FIG. 3 is a flowchart illustrating a method for on-site parameter generation for microphones according to an embodiment.

FIG. 3 is an exemplary and non-limiting flowchart 300 illustrating a method for on-site microphone calibration according to an embodiment. In an embodiment, the method of FIG. 3 may be performed by a control unit (e.g., the control unit 140). In S310, a sound source located is configured to generate a transmission. In S320, a plurality of microphones is configured to capture the transmission.

In S330, for each of the microphones, the captured transmission is analyzed to determine a plurality of location pointers respective thereof. In S340, it is determined whether additional transmissions are needed for the parameterization. If so, execution continues with S310; otherwise, execution continues with S350.

In S350, at least one location parameter is determined for each microphone respective of the location pointers for the microphone. The location parameters may include, but are not limited to, the exact location of each microphone of the plurality of microphones within a three-dimensional space, the distance between each of the microphones, and/or the rotation angle of a microphone array. Determination of location parameters based on location pointers is described further herein above with respect to FIGS. 1 and 2.

In S360, the microphones are calibrated based on the location parameters. The calibration may include muting, eliminating, or reducing the side lobe sounds in order to isolate audio of a desired sound beam within the three-dimensional space. In an embodiment, the calibration may be performed based on metadata.

Figure 4:
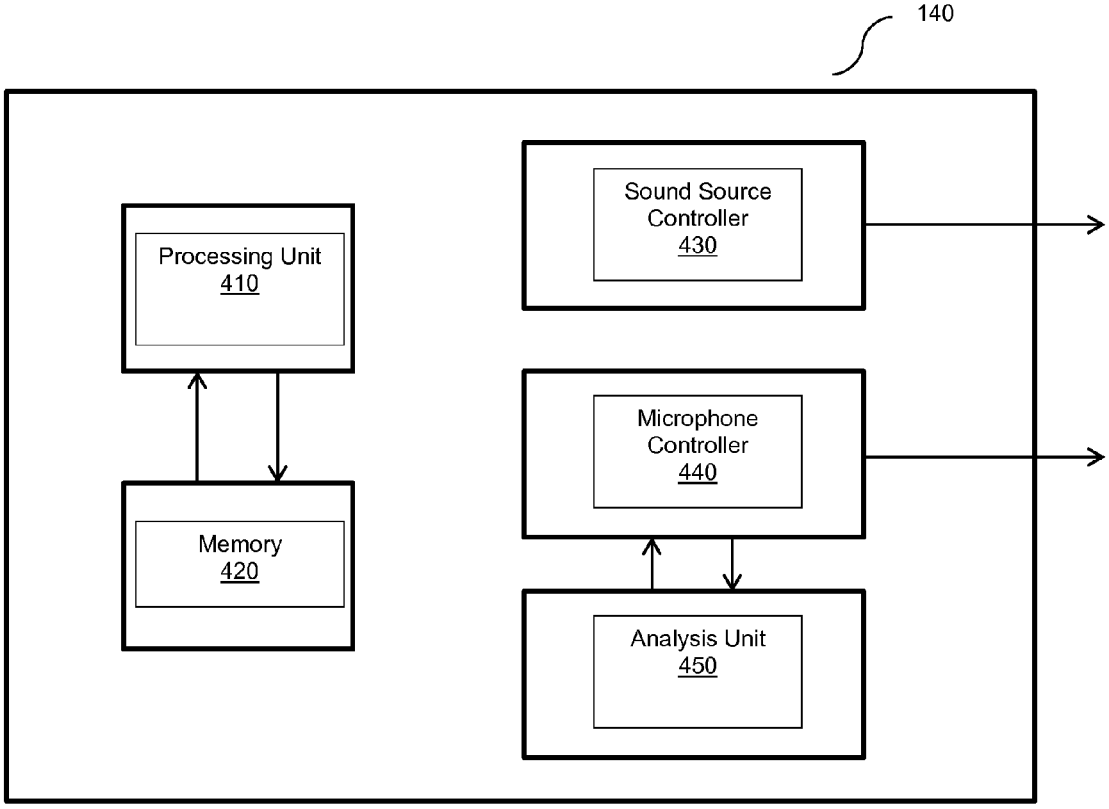
FIG. 4 is a block diagram of a control unit for controlling on-site parameter generation for microphones according to an embodiment.

FIG. 4 is an exemplary and non-limiting block diagram of a control unit 140 for on-site calibration of microphones according to an embodiment. The control unit 140 includes a processing unit 410 coupled to a memory 420. The memory 420 contains instructions that, when executed by the processing unit 410, configure the control unit to perform the embodiments disclosed herein.

The processing unit 410 may comprise or be a component of a processor (not shown) or an array of processors coupled to the memory 420. The memory 420 contains instructions that can be executed by the processing unit 410. The instructions, when executed by the processing unit 410, cause the processing unit 410 to perform the various functions described herein. The one or more processors may be implemented with any combination of general-purpose microprocessors, multi-core processors, microcontrollers, digital signal processors (DSPs), field programmable gate array (FPGAs), programmable logic devices (PLDs), controllers, state machines, gated logic, discrete hardware components, dedicated hardware finite state machines, or any other suitable entities that can perform calculations or other manipulations of information The control unit 140 also includes a sound source controller 430. The sound source controller 430 is configured to cause sound sources (e.g., the sound source 130 or 230) to generate transmissions.

The control unit 140 additionally includes a microphone controller 440. The microphone controller 440 is configured to cause at least one microphone (e.g., the plurality of microphones 110 or the array of microphones 215) to receive transmissions generated by the sound sources. The microphone controller 440 is further configured to receive the captured transmissions from the microphones.

The control unit 140 also includes an analysis unit 450. The analysis unit is configured to receive the captured transmissions from the microphone controller 440 and to analyze the captured transmissions to determine location pointers respective of each microphone. Based on the location pointers, the analysis unit 450 is configured to determine at least one location parameter of each microphone as described further herein above with respect to FIGS. 1 and 2. The location parameters may include, but are not limited to, the exact location of each microphone within a three-dimensional space, the distance between each of the microphones, and/or the rotation angle of a microphone array.

Based on the at least one location parameter of the microphones, the microphone controller 440 may be configured to calibrate the microphones. According to another embodiment, the calibration may be performed based on metadata stored in, e.g., the analysis unit 450. The calibration may include muting, eliminating, or reducing the side lobe sounds in order to isolate audio of a desired sound beam within the three-dimensional space.

The various embodiments disclosed herein can be implemented as hardware, firmware, software, or any combination thereof. Moreover, the software is preferably implemented as an application program tangibly embodied on a program storage unit or computer readable medium consisting of parts, or of certain devices and/or a combination of devices. The application program may be uploaded to, and executed by, a machine comprising any suitable architecture. Preferably, the machine is implemented on a computer platform having hardware such as one or more central processing units ("CPUs"), a memory, and input/output interfaces. The computer platform may also include an operating system and microinstruction code. The various processes and functions described herein may be either part of the microinstruction code or part of the application program, or any combination thereof, which may be executed by a CPU, whether or not such a computer or processor is explicitly shown. In addition, various other peripheral units may be connected to the computer platform such as an additional data storage unit and a printing unit. Furthermore, a non-transitory computer readable medium is any computer readable medium except for a transitory propagating signal.

All examples and conditional language recited herein are intended for pedagogical purposes to aid the reader in understanding the principles of the disclosed embodiment and the concepts contributed by the inventor to furthering the art, and are to be construed as being without limitation to such specifically recited examples and conditions. Moreover, all statements herein reciting principles, aspects, and embodiments of the disclosed embodiments, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

What is claimed is:

1. A method for on-site calibration of a plurality of microphones in a three-dimensional space, comprising:

causing a generation of a plurality of transmissions;

causing each microphone to capture each transmission, wherein one of the microphones is selected as a reference microphone;

estimating, for each microphone, a plurality of location pointers based on the captured transmissions, wherein each location pointer represents a time difference between the microphone and the reference microphone;

determining, based on each location pointer, at least one location parameter for each microphone wherein each location parameter includes a location coordinate of its respective microphone; and calibrating the plurality of microphones based on the at least one location parameter.

2. The method of claim 1, wherein the plurality of transmissions are generated by one sound source, wherein the sound source generates each transmission at a different location in the three-dimensional space.

3. The method of claim 1, wherein the location of each of the plurality of microphones within the three-dimensional space is not geometrically knowable with respect to any one of the microphones based on the arrangement of the microphones within the three-dimensional space.

4. The method of claim 1, wherein the plurality of transmissions are generated based on metadata.

5. The method of claim 4, wherein the metadata is at least one of: a type of transmission, a volume, and a length.

6. The method of claim 1, wherein each location parameter further includes at least one of: an estimated speed of sound within the three-dimensional space and an angle of rotation of the plurality of microphones.

7. The method of claim 1, wherein calibrating the plurality of microphones further comprises any one of: muting side lobe sounds, eliminating side lobe sounds, reducing side lobe sounds, and determining a sound beam using a beam forming technique.

8. The method of claim 1, further comprising:

determining, based on the plurality of location pointers, any of: a gain of each microphone, a sound velocity within the three-dimensional space, metadata related to the phase of each microphone, and a dispersion of each microphone.

9. The method of claim 1, further comprising:

determining, based on each location pointer, a plurality of location parameters for a plurality of sound sources, wherein each sound source generates a transmission of the plurality of transmissions.

10. A non-transitory computer readable medium having stored thereon instructions for causing one or more processing units to execute the method according to claim 1.

11. A system for on-site generation of parameters for a plurality of microphones in a three-dimensional space, comprising:

a processing unit; and a memory, the memory containing instructions that, when executed by the processing unit, configure the system to:

cause a generation of a plurality of transmissions;

cause each microphone to capture each transmission, wherein one of the microphones is selected as a reference microphone;

estimate, for each microphone, a plurality of location pointers based on the captured transmissions, wherein each location pointer represents a time difference between the microphone and the reference microphone;

determine, based on each location pointer, at least one location parameter for each microphone wherein each location parameter includes a location coordinate of its respective microphone; and calibrate the plurality of microphones based on the at least one location parameter.

12. The system of claim 11, wherein the plurality of transmissions are generated by one sound source, wherein the sound source generates each transmission at a different location in the three-dimensional space.

13. The system of claim 11, wherein the location of each of the plurality of microphones within the three-dimensional space is not geometrically knowable with respect to any one of the microphones based on the arrangement of the microphones within the three-dimensional space.

14. The system of claim 11, wherein the plurality of transmissions is generated based on metadata.

15. The system of claim 14, wherein the metadata is at least one of: a type of transmission, a volume, and a length.

16. The system of claim 11, wherein each location parameter includes at least one of: an estimated speed of sound within the three-dimensional space and an angle of rotation of the plurality of microphones.

17. The system of claim 11, wherein calibrating the plurality of microphones further comprises any one of: muting side lobe sounds, eliminating side lobe sounds, reducing side lobe sounds, and determining a sound beam using a beam forming technique.

18. The system of claim 11, wherein the system is further configured to:

determine, based on the plurality of location pointers, any one of: a gain of each microphone, a sound velocity within the three-dimensional space, metadata related to the phase of each microphone, and a dispersion of each microphone.

19. The system of claim 11, wherein the system is further configured to:

determine, based on each location pointer, a plurality of location parameters for a plurality of sound sources, wherein each sound source generates a transmission of the plurality of transmissions.

20. The system of claim 13, wherein the system is further configured to:

cause the generation of the plurality of transmissions by a single sound source; and rotating, for each transmission of the plurality of transmissions, the plurality of microphones by an angle of rotation to estimate the plurality of location pointers.

* * * * *